US007026559B2

(12) United States Patent
James

(10) Patent No.: US 7,026,559 B2
(45) Date of Patent: Apr. 11, 2006

(54) SWITCH WITH INSULATION DISPLACEMENT CONNECTORS

(75) Inventor: Stephen C. James, San Pedro, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 74 days.

(21) Appl. No.: 10/665,839

(22) Filed: Sep. 19, 2003

(65) Prior Publication Data

US 2005/0061642 A1 Mar. 24, 2005

(51) Int. Cl.
*H01R 24/00* (2006.01)

(52) U.S. Cl. ..... 200/51 R; 200/284; 439/410; 439/404

(58) Field of Classification Search ..... 439/409, 439/410, 404, 417, 395, 412; 200/284, 51 R
See application file for complete search history.

(56) References Cited

U.S. PATENT DOCUMENTS 3,012,219 A 12/1961 Levin et al.
3,931,487 A 1/1976 Russenberger
4,019,801 A 4/1977 Hoffman
4,169,974 A 10/1979 Peers-Trevarton
4,461,528 A * 7/1984 Durand et al. ..... 439/409
4,754,104 A 6/1988 Maltais et al.
4,891,018 A 1/1990 Afflerbaugh et al.
5,435,747 A * 7/1995 Franckx et al. ..... 439/409
5,541,376 A * 7/1996 Ladtkow et al. ..... 200/284
5,675,890 A * 10/1997 Yamamoto et al. ..... 29/861
5,871,374 A * 2/1999 Maney ..... 439/596
5,961,341 A * 10/1999 Knowles et al. ..... 439/403
6,093,048 A 7/2000 Arnett et al.
6,236,006 B1 * 5/2001 Wecke ..... 200/284
6,312,282 B1 * 11/2001 Blaha et al. ..... 439/402

* cited by examiner

*Primary Examiner*—K. Lee
(74) *Attorney, Agent, or Firm*—Christie, Parker & Hale, LLP

(57) ABSTRACT

A switch has insulation displacement connectors on a connector portion of the switch body. Such an insulation displacement connector has two tines with an open-ended slot for receiving a wire transverse to the slot. When the wire is pushed along the length of the slot, insulation is displaced and there is electrical contact made with the connector. An insulating flap is hinged to the switch body for rotation between an open position, an intermediate catch position at an acute angle from the connector portions, and a latched position approximately parallel to the connector portion. Rotating the flap from the catch position to the latched position presses wires into the insulation displacement connectors. Each of the connectors has a generally keyhole-shaped opening for receiving the wire. The axis of the hinge between the flap and body is approximately parallel to the length of the wire in the connector and is integrally molded with the switch body and flap. Guides are provided between the body and flap for assuring alignment therebetween. Hooks and shoulders hold the flap in the catch and latched positions, respectively.

5 Claims, 3 Drawing Sheets

SWITCH WITH INSULATION DISPLACEMENT CONNECTORS

FIELD OF THE INVENTION

This invention relates to an electrical switch which has at least one insulation displacement connector for making electrical contact with insulated wires attached to the switch.

BACKGROUND

Insulation displacement connectors (commonly referred to as IDCs) have been known at least as early as 1961, as shown in U.S. Pat. No. 3,012,219. They are widely used for making telephone connections, for example. Such connectors have been used on electrical switches such as, for example, in U.S. Pat. No. 4,754,104. Better ways of implementing and making connections to a switch with an IDC are desirable.

BRIEF SUMMARY OF THE INVENTION

There is, therefore, provided in practice of this invention a switch body including a connector portion with an insulation displacement connector on the connector portion. (A typical insulation displacement connector has two tines with an open slot therebetween for receiving a wire transverse to the slot and sufficiently close together to displace insulation from such a wire pressed into the slot along the length of the slot, and make electrical contact with the wire.) A number of features improve the switch, such as, for example, an insulating flap hinged to the switch body so that the flap has an open position, a catch position beyond the open end of the slot in an IDC, and a latched position with a portion straddling the slot and securing a wire in the slot. Moving the flap from the catch position to the latched position presses the wire along the length of the slot. Preferably the flap is hinged to the switch body with the axis of the hinge being parallel to a wire in the slot.

BRIEF DESCRIPTION OF THE DRAWINGS

These and other features and advantages of the invention will be appreciated as the same becomes better understood by reference to the following description when considered in connection with the accompanying drawings wherein.

DETAILED DESCRIPTION OF THE INVENTION

Figure 1:
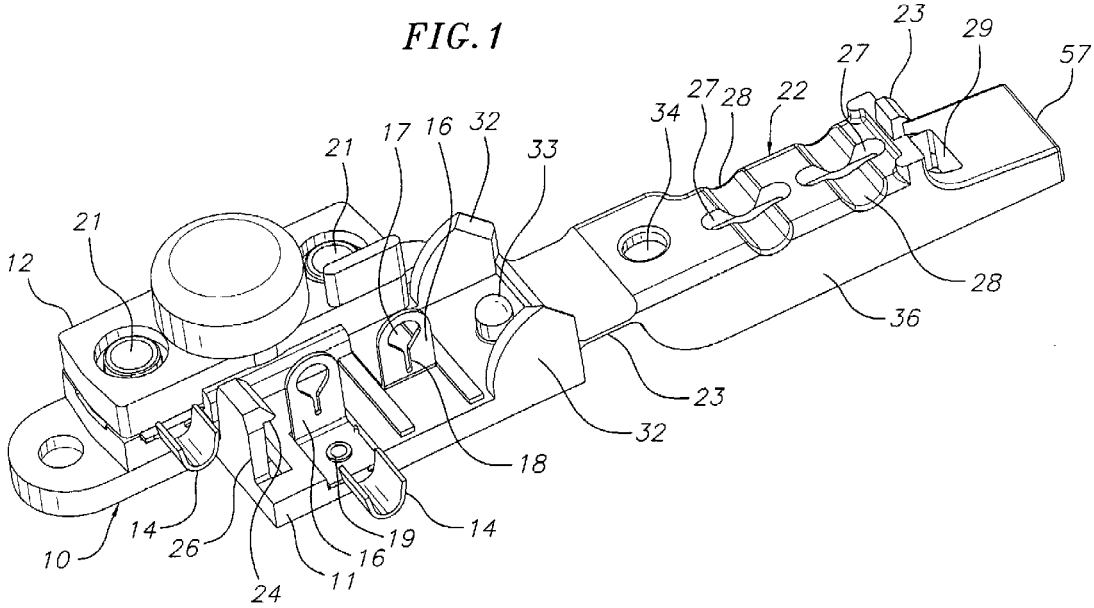
FIG. 1 illustrates in perspective a switch and flap with the flap in an open position.

The switch has a plastic body 10 with a connector portion 11 toward one side of a switch housing or cover 12. The operating mechanism of the switch is between the body and cover and is essentially hidden from view in the drawings. The switch mechanism is immaterial for an understanding of the invention nor how to make or use it. An exemplary switch is a normally-OFF, momentary-ON switch which effectively operates like a doorbell button. When the plunger 13 of the switch is pressed, electrical contact is made, closing the switch, and when the plunger is released, contact is broken. This is merely exemplary, and the switch could be any other of a variety of formats, such as a normally-ON momentary-OFF or an ON-OFF-ON-OFF switch, such as a ratchet switch, which has alternating ON and OFF positions with successive pushes of the plunger. Three pole and other switches may also benefit from use of improved insulation displacement connector arrangements as described hereinafter.

In the illustrated embodiment, the switch includes four places for making external electrical connections. Two of these have conventional troughs 14 for making a crimped connection to a multi-strand wire. In an exemplary use of such a switch, wires connected to a lamp are crimped to these connectors. Such a switch may be delivered by the manufacturer with a lamp already connected or may be sent with empty connectors for the customer to make its own connections.

The other two electrical connections are insulation displacement connectors (IDCs) 16. Each IDC is a metal sheet having a keyhole shaped opening 17 which defines a pair of parallel tines which straddle a slot 18 therebetween. Since this is a keyhole shaped opening, the two tines essentially extend upwardly and around the upper part of the keyhole to meet at the top and find a guide opening in the wire adjacent the open end of the slot.

Thus, to make electrical connection, a wire is placed through the larger opening of the keyhole and is then pressed downwardly along the length of the slot. This displaces insulation from the wire so that the tines make electrical contact with the wire. Such an IDC can be designed with a slot width appropriate for use with either solid wire or multi-strand wire. The slot may have parallel sides or convergence.

The metal pieces for connectors are fastened to the switch body by rivets 19 and 21, two of which 21 also secure the switch housing or cover to the injection molded plastic body.

A flap 22 is attached to the connector portion of the body by a thin hinge 23. The body, hinge and flap are integrally molded of a plastic that is sufficiently flexible to form a hinge. A preferred plastic is nylon (e.g., nylon 6/6), although acetal, polypropylene and other plastics are also suitable.

The flap has three positions relative to the body of the switch. Its open position lies more or less parallel to the connector portion of the switch body as illustrated in FIG. 1. This would be the typical position of the flap as the body and flap are taken from the mold.

Figure 2:
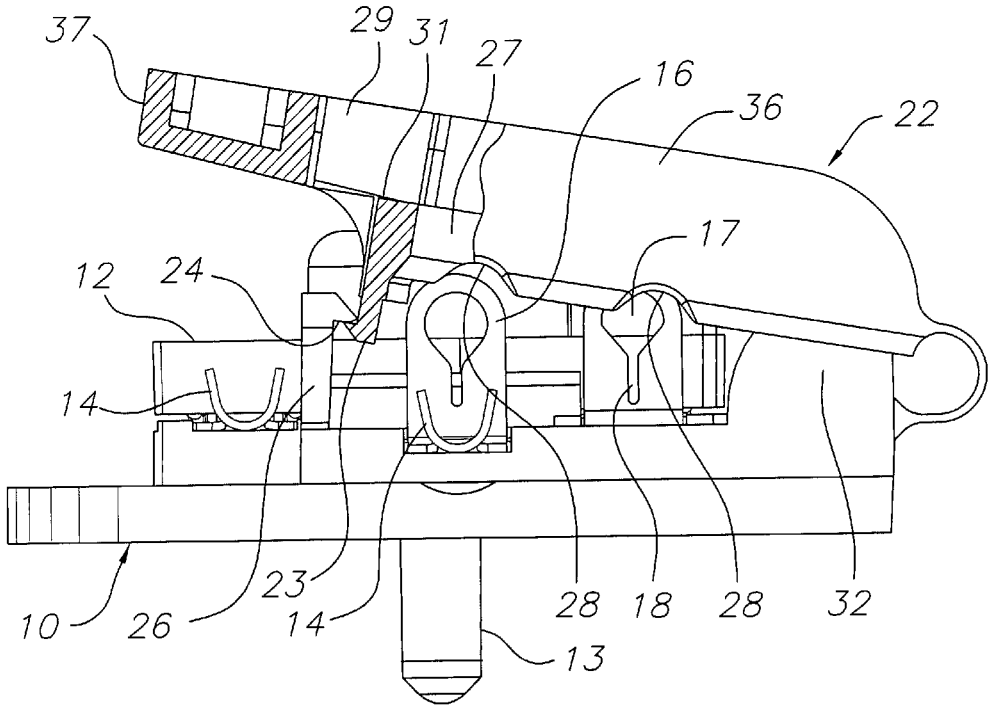
FIG. 2 is a side view of the switch with the flap in an intermediate catch position.
Figure 3:
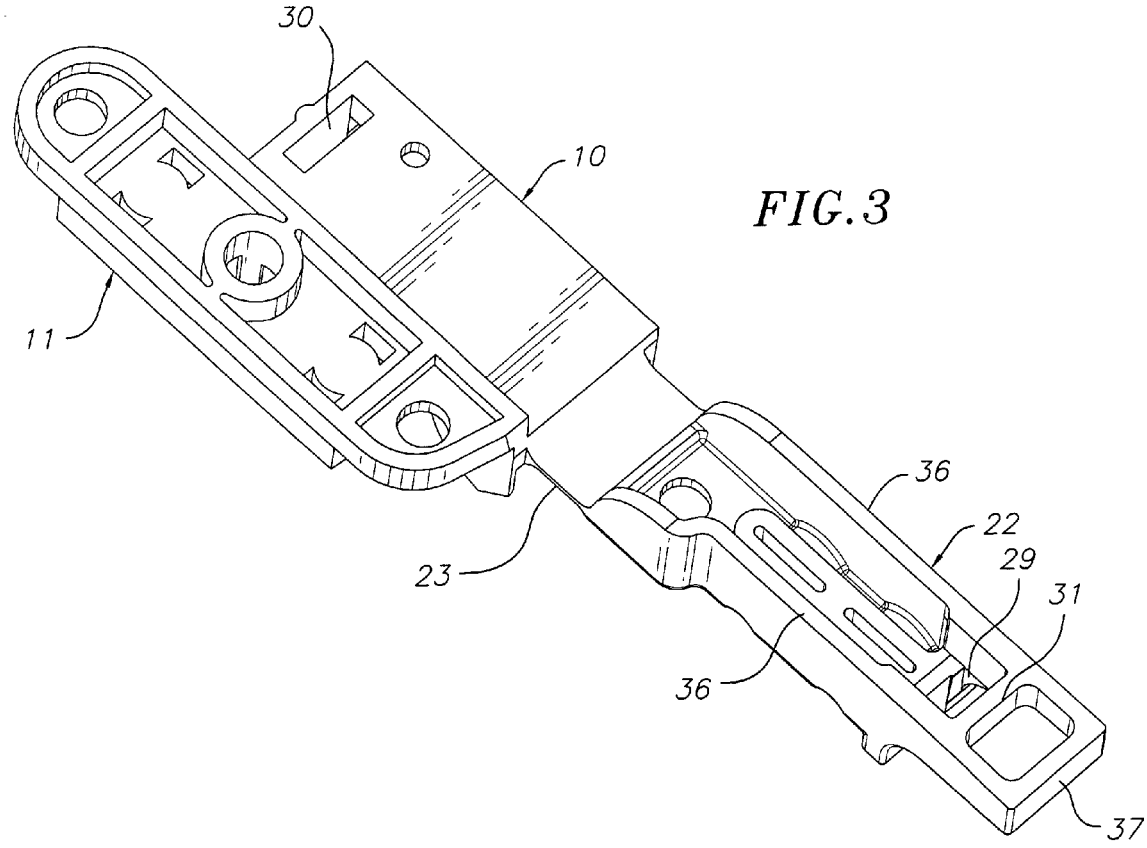
FIG. 3 is a bottom view of the switch body with the flap in its open position.

The flap has a second "catch" position when it is rotated around the plastic hinge to lie at an acute angle (e.g., in the range of from about 10 to 20°) from the connector portion, as illustrated in FIG. 2. In this position, a hook 25 on the flap engages a raised shoulder 24 on the connector portion of the switch body. The shoulder is on an arm 26, which is thin enough to bend as the shoulder engages the flap. The hook 25 is also somewhat flexible. Thus, as the flap is rotated into the catch position, the shoulder and/or hook bend slightly so that the hook can pass the shoulder. The hook and shoulder then snap back to a position as seen in FIG. 2 with the hook and shoulder in engagement to prevent the flap from rotating back toward the open position. (The hook and/or shoulder can be deflected manually, if desired, to release the flap from the catch position.)

When the flap is rotated around the hinge to the catch position, the top of each of the IDCs enters a respective narrow slit 27 along the center line of the flap. The flap also has two grooves 28 extending across the flap which align with the respective IDCs when the flap is in the catch position. These transverse grooves provide clearance adjacent to the large upper portion of the keyhole opening in the IDCs so that wires can be inserted through the openings.

The flap has a third latched position where it is rotated further around the hinge so that the flap lies approximately parallel to the connector portion of the switch. When rotated into the latched position, the shoulder 24 on the arm 26 passes through a clearance passage 29 near the end of the flap and engages a second shoulder 31 on the flap to retain the flap in the latched position.

When the flap is rotated from the catch position toward the latched position, the flap (via the transverse grooves 28) engages a wire in the large opening of each IDC and presses the wire along the length of the slot 18, thereby displacing insulation and making electrical contact between the wire and tines. The flap in its latched position holds the wire in place in the IDC.

There is a clearance hole 30 through the connector portion for receiving the hook 25 on the flap when the flap is rotated to the latched position. Latching in this position is by engagement of the mating shoulders on the switch and flap respectively. The hook is not in engagement with anything in the latched position.

If desired, the manufacturer may ship the switch to the customer with the flap already pivoted into the catch position. Then, all the customer has to do is insert the wires into the keyhole shaped openings and press the flap to the latched position to complete the connections.

Although as described and illustrated the open position of the flap lies approximately parallel to the connector portion of the switch, it is found that after once rotating the flap from this parallel position to near the catch position, there is some plastic deformation of the hinge and the flap does not return to the "full open" position. Instead the flap may rest at an acute angle from the catch position. This is still considered to be part of the open position.

A pair of alignment wings 32 extend upwardly from the connector portion of the switch near the flexible hinge. When the flap is rotated toward the catch position, the wings straddle the sides of the flap to keep the axis of the hinge approximately parallel to the wires in the IDCs to assure that the slits 27 properly fit over the ends of the IDCs. There is also a short stud or boss 33 on the switch body which enters a matching hole 34 in the flap when the flap is rotated toward the catch position. There might be variation in location of the hinge axis in the more or less flat portion between the body and flap, and the engagement of the boss and hole assures appropriate positioning in a direction transverse to the hinge axis. That is, side to side alignment of the flap is provided by the wings straddling the flap and longitudinal alignment is assured by reason of the boss and hole.

The flap has the general shape of an elongated trough with the slits being through the bottom of the trough. That is to say, the flap has a generally U-shaped transverse cross-section with the slits being in the bottom of the U. The upstanding ribs 36 along the length of this trough provide the stiffening of the flap to minimize bending and twisting. This is an appropriate way of stiffening while maintaining the thickness of the plastic roughly the same throughout the molded part, which is desirable for injection molding.

There is an extension 37 on the end of the flap beyond the hook and clearance passage 29, which does not directly affect functioning of the flap. The extension provides some additional leverage for pressing the wires into the slots when the flap moves from the catch position to the latched position, which may be desirable if the flap is closed manually. Such an extension may be insignificant when the flap is closed with automated equipment. The extension is more a matter of convenience than necessity.

The alignment features (wings, boss and hole) are desirable since a typical switch of this nature is quite small and good alignment is desirable for proper operation of the IDCs. For example, when the wire being positioned in the IDC has a 50 mil diameter (0.05 inch), the clearance between the slits and metal IDC is about 6 mils on each side.

The switch embodying this invention need not be made exactly as described and illustrated. Modifications and variations will be apparent to those skilled in the art. Thus, for example, such a switch may have one, two, three or more IDCs. A flap may be hinged differently, although an integrally molded flexible hinge is quite economical. Alignment of the flap and switch body may be assured with a different boss and hole arrangement, and the straddling wings may be deleted. Even the IDCs may be changed somewhat. In this embodiment, they are illustrated as having a parallel-sided slot to receive the wire, whereas other embodiments prefer a slightly tapered slot. Thus, it is to be understood that within the scope of the appended claims, this invention may be practiced otherwise than as specifically described and illustrated.

What is claimed is:

1. A switch comprising:

a switch body including a connector portion;

at least a pair of insulation displacement connectors on the connector portion, each insulation displacement connector having two metal tines with an open ended slot therebetween for receiving a wire transverse to the slot, and sufficiently close together to displace insulation from such a wire pressed into the slot along the length of the slot and make electrical contact with the wire; and an insulating flap hinged to the switch body, the hinge comprising a thin layer of plastic integral with the connector portion and the flap, the axis of the hinge being parallel to such a wire in the slot;

a pair of guide wings on the connector portion straddling edges of the flap adjacent to the hinge;

a guide pin on one of the connector portion and the flap, and an alignment hole on the other of the flap and connector portion for engaging the guide pin;

a hook on a flexible arm on the connector portion;

a first shoulder on the flap located to engage the hook in a latched position;

a second shoulder on the flap located to engage the hook in an intermediate position between the open position and the latched position;

a pair of rounded grooves inside the flap, each groove extending parallel to such a wire in the slot of one of the insulation displacement connectors and lying adjacent to the open end of the slot in the intermediate position of the flap;

a pair of slits in the flap aligned with the insulation displacement connectors when the flap is in the latched position, the edges of the slits straddling the respective insulation displacement connectors for pressing a wire into the slot between two tines.

2. A switch according to claim 1 wherein the hinge, flap and switch body are integrally molded plastic.

3. A switch according to claim 1 wherein the flap has the general shape of an elongated trough, the slits being through the bottom of the trough.

4. A switch according to claim 1 wherein the flap has a generally U-shaped cross section transverse to its length, the slits being through the base of the U and the arms of the U stiffening the flap against bending and twisting.

5. A switch according to claim 1 further comprising an extension on the end of each of the tines, the extensions meeting beyond the open end of the slot to form a guide opening for wire adjacent the open end of the slot.

* * * * *

UNITED STATES PATENT AND TRADEMARK OFFICE

CERTIFICATE OF CORRECTION

PATENT NO. : 7,026,559 B2
APPLICATION NO. : 10/665839
DATED : April 11, 2006
INVENTOR(S) : James It is certified that error appears in the above-identified patent and that said Letters Patent is hereby corrected as shown below:

In the Claims

ALL CLAIMS

Column 4, line 26 through Column 6, line 2, Claims 1-5

Delete Claims 1-5 as listed in Patent.

Insert --1. A switch comprising:

a switch body including a connector portion;

an insulation displacement connector on the connector portion, the insulation displacement connector having two tines with an open ended slot therebetween for receiving a wire transverse to the slot, and sufficiently close together to displace insulation from such a wire pressed into the slot along the length of the slot and make electrical contact with the wire; and an insulating flap hinged to the switch body, the flap having an open position, a catch position beyond the open end of the slot from which the flap does not rotate back toward the open position, and a latched position with a portion straddling the slot and securing a wire in the slot.

2. A switch according to claim 1 wherein the hinge, flap and switch body are integrally molded plastic.

3. A switch according to claim 1 further comprising guide means for aligning the flap and body.

4. A switch comprising:

a switch body including a connector portion;

an insulation displacement connector on the connector portion; and an insulating flap hinged to the switch body, the flap having an open position, a latched position parallel to the connector portion and an intermediate catch position with the flap at an acute angle in the range of from about 10 to 20 degrees from the connector portion, and from which the flap does not rotate back toward the open position.

5. A switch comprising:

a switch body including a connector portion;

an insulation displacement connector on the connector portion, the insulation displacement connector having two tines with an open ended slot therebetween for receiving a wire transverse to the slot, and sufficiently close together to displace insulation from opposite edges of such a wire pressed into the It is certified that error appears in the above-identified patent and that said Letters Patent is hereby corrected as shown below:

slot along the length of the slot and make electrical contact with the wire; and an insulating flap hinged to the switch body, the axis of the hinge being parallel to such a wire in the slot.

6. A switch according to claim 5 wherein the hinge, flap and switch body are integrally molded plastic.

7. A switch according to claim 5 further comprising guide means for aligning the flap and body.

8. A switch comprising:

a switch body including a connector portion;

an insulation displacement connector on the connector portion for displacing insulation along opposite edges of a wire;

an insulating flap hinged to the switch body; and a guide member between the flap and connector portion.

9. A switch according to claim 8 wherein the guide member is adjacent to the hinge.

10. A switch according to claim 8 wherein the guide member comprises a pin on one of the connector portion and the flap and a hole aligned with the pin on the other of the flap and connection portion.

11. A switch according to claim 8 wherein the guide member comprises a pair of wings on the connector portion straddling edges of the flap adjacent to the hinge.

12. A switch comprising:

a switch body including a connector portion;

an insulation displacement connector on the connector portion;

an insulating flap hinged to the switch body, a hook on the connector portion, a first shoulder on the flap located to engage the first position and a second shoulder on the flap located to engage the hook in a second position.

It is certified that error appears in the above-identified patent and that said Letters Patent is hereby corrected as shown below:

13. A switch according to claim 12 wherein the hook is on a flexible arm.

14. A switch comprising:

a switch body including a connector portion;

an insulation displacement connector on the connector portion, the insulation displacement connector having two tines with an open ended slot therebetween for receiving a wire transverse to the slot, and sufficiently close together to displace insulation from such a wire pressed into the slot along the length of the slot and make electrical contact with the wire; and an insulating flap lunged to the switch body, including a rounded groove in side the flap extending parallel to such a wire in the slot, the flap being rotatable about an axis parallel to a wire in such an insulation displacement connector.

15. A switch according to claim 14 further comprising a slit in the flap aligned with the insulation displacement connector when the flap is in a latched position approximately parallel to the switch body, the edges of the slit straddling the insulation displacement connector for pressing a wire into the slot between two tines.

16. A switch comprising:

a switch body including a connector portion;

an insulation displacement connector on the connector portion, the insulation displacement connector having two tines with an open ended slot therebetween for receiving a wire transverse to the slot, and sufficiently close together to displace insulation from such a wire pressed into the slot along the length of the slot and make electrical contact with the wire; and an extension on the end of each of the tines, the extensions meeting beyond the open end of the slot to form a guide opening for wire adjacent the open end of the slot.

17. A switch comprising:

a switch body including a connector portion;

an insulation displacement connector on the connector portion, the insulation displacement connector having two tines with an open ended slot therebetween for receiving a wire transverse to the slot, and sufficiently close together to displace It is certified that error appears in the above-identified patent and that said Letters Patent is hereby corrected as shown below:

insulation from such a wire pressed into the slot, along the length of the slot and make electrical contact with the wire; and an extension on the end of each of the tines, the extensions meeting beyond the open end of the slot to form a keyhole shaped opening.

18. A switch comprising:

a switch body including a connector portion;

at least a pair of insulation displacement connectors on the connector portion, each insulation displacement connector having two metal tines with an open ended slot therebetween for receiving a wire transverse to the slot, and sufficiently close together to displace insulation from such a wire pressed into the slot along the length of the slot and make electrical contact with the wire; and an insulating flap hinged to the switch body, the hinge comprising a thin layer of plastic integral with the connector portion and the flap, the axis of the hinge being parallel to such a wire in the slot;

a pair of guide wings on the connector portion straddling edges of the flap adjacent to the hinge;

a guide pin on one of the connector portion and the flap, and an alignment hole on the other of the flap and connector portion for engageing the guide pin;

a hook on a flexible arm on the connector portion;

a first shoulder on the flap located to engage the hook in a latched position;

a second shoulder on the flap located to engage the hook in an intermediate position between the open position and the latched position;

a pair of rounded grooves inside the flap, each groove extending parallel to such a wire in the slot of one of the insulation displacement connectors and lying adjacent to the open end of the slot in the intermediate position of the flap;

a pair of slits in the flap aligned with the insulation displacement connectors when the flap is in the latched position, the edges of the slits straddling the respective insulation displacement connectors for pressing a wire into the slot between two tines.

UNITED STATES PATENT AND TRADEMARK OFFICE

CERTIFICATE OF CORRECTION

PATENT NO. : 7,026,559 B2
APPLICATION NO. : 10/665839
DATED : April 11, 2006
INVENTOR(S) : James It is certified that error appears in the above-identified patent and that said Letters Patent is hereby corrected as shown below:

19. A switch according to claim 18 wherein the hinge, flap and switch body are integrally molded plastic.

20. A switch according to claim 18 wherein the flap has the general shape of an elongated trough, the slits being through the bottom of the trough.

21. A switch according to claim 18 wherein the flap has a generally U-shaped cross section transverse to its length, the slits being through the base of the U and the arms of the U stiffening the flap against bending and twisting.

22. A switch according to claim 18 further comprising an extension on the end of each of the tines, the extensions meeting beyond the open end of the slot to form a guide opening for wire adjacent the open end of the slot.--

Signed and Sealed this

Twenty-first Day of November, 2006

JON W. DUDAS
*Director of the United States Patent and Trademark Office*